United States Patent [19]

Fabris

[11] Patent Number: 4,700,875

[45] Date of Patent: Oct. 20, 1987

[54] ROLLER ENTRY GUIDE

[76] Inventor: Mario Fabris, 1216 S. Service Rd., P.O. Box 220, Winona, (Ont.) L0R 2L0, Canada

[21] Appl. No.: 650,466

[22] Filed: Sep. 13, 1984

[51] Int. Cl.[4] ..... B65H 57/14; B65H 57/28

[52] U.S. Cl. ..... 226/189; 226/176

[58] Field of Search ..... 226/189, 174, 176; 72/250, 428

[56] References Cited

U.S. PATENT DOCUMENTS

| | | | |
|---|---|---|---|
| 670,654 | 3/1901 | Allis . | |
| 1,746,483 | 2/1930 | Loyd et al. . | |
| 1,814,735 | 7/1931 | Palmgren . | |
| 2,178,904 | 11/1939 | Garman | 72/250 |
| 2,264,218 | 11/1941 | O'Malley . | |
| 3,620,063 | 11/1971 | Kursinczky . | |
| 3,765,214 | 10/1973 | Boehmer . | |
| 3,776,013 | 12/1973 | Groh et al. . | |
| 4,039,107 | 8/1977 | Boley . | |
| 4,088,333 | 5/1978 | Nobile et al. . | |
| 4,150,772 | 4/1979 | Auer | 226/176 X |
| 4,177,912 | 12/1979 | Samokovliski et al. | 226/176 |
| 4,212,181 | 7/1980 | Shimada . | |
| 4,250,734 | 2/1981 | Tinsley . | |
| 4,483,169 | 11/1984 | Jahr et al. . | |

FOREIGN PATENT DOCUMENTS

| | | |
|---|---|---|
| 0013671 | 1/1979 | European Pat. Off. . |
| 0103667 | 2/1983 | European Pat. Off. . |
| 193187 | 8/1905 | Fed. Rep. of Germany . |
| 1173423 | 7/1964 | Fed. Rep. of Germany . |
| 19657 | of 1911 | United Kingdom . |
| 674098 | 6/1952 | United Kingdom . |
| 1581100 | 2/1978 | United Kingdom . |

*Primary Examiner*—Stuart S. Levy
*Assistant Examiner*—Lynn M. Sohacki
*Attorney, Agent, or Firm*—Fleit, Jacobson, Cohn & Price

[57] ABSTRACT

A roller entry guide comprises a body with a pair of roller assemblies mounted on the body. The spacing between the assemblies is adjustable by a gear mechanism that induces relative longitudinal displacement between the body and the assemblies. Slides acting between the body and the assemblies produces a lateral component of movement to move the assemblies toward or away from each other while maintaining them parallel.

8 Claims, 6 Drawing Figures

ROLLER ENTRY GUIDE

The present invention relates to roller entry guides and in particular to a roller entry guide that provides the possibility of adjustment during operation.

Roller entry guides are used on a rod mill to guide the rod into the next stage of the mill. Such guides conventionally have a tapering inlet chute that guides the rod between a set of rollers. The rollers then ensure that the rod is presented to the rolls in the correct orientation.

The roller entry guides are normally set up at the start of a production run so that the spacing between the rollers corresponds to the nominal diameter of the rod that will be passing between them. It has been found however that variations in the stock size induce undue wear on the rollers and leads to frequent stoppages for adjustment and maintenance.

Proposals have been made to bias the rollers against stops so that the rollers may swing out of the set position should an increase in stock diameter be encountered. Whilst this has been proposed for rollers utilising two rolls it has not been possible to use it where the guide has four rollers arranged in pairs on opposite sides of the material. The use of four rollers is preferred because of the increased stability it provides in operation but it is then essential that the pair of rollers be maintained parallel to one another at all times. However, with the currently available arrangements of four roller entry guides, any variation in material thickness requires a production run to be stopped for subsequent readjustment of the roller entry guides.

It is therefore an object of the present invention to provide a roller entry guide in which adjustment may be made whilst the material is passing through the roller entry guide to obviate or mitigate the above disadvantages.

According therefore to the present invention there is provided a roller entry guide to guide material along a longitudinal axis, said guide having a body, a pair of generally parallel roller assemblies moveably mounted on said body each of said roller assemblies being located on an opposite side of said longitudinal axis to define a passageway for material moving along said axis, adjustment means acting between said roller assembly and said body to induce relative movement therebetween and guide means acting between said roller assemblies and said body to guide said roller assemblies toward and away from said longitudinal axis and maintain said roller assemblies in a predetermined disposition relative to said longitudinal axis upon movement being induced by said adjusting means.

An embodiment of the invention will now be described by way of example only with reference to the accompanying drawings in which.

Figure 1:
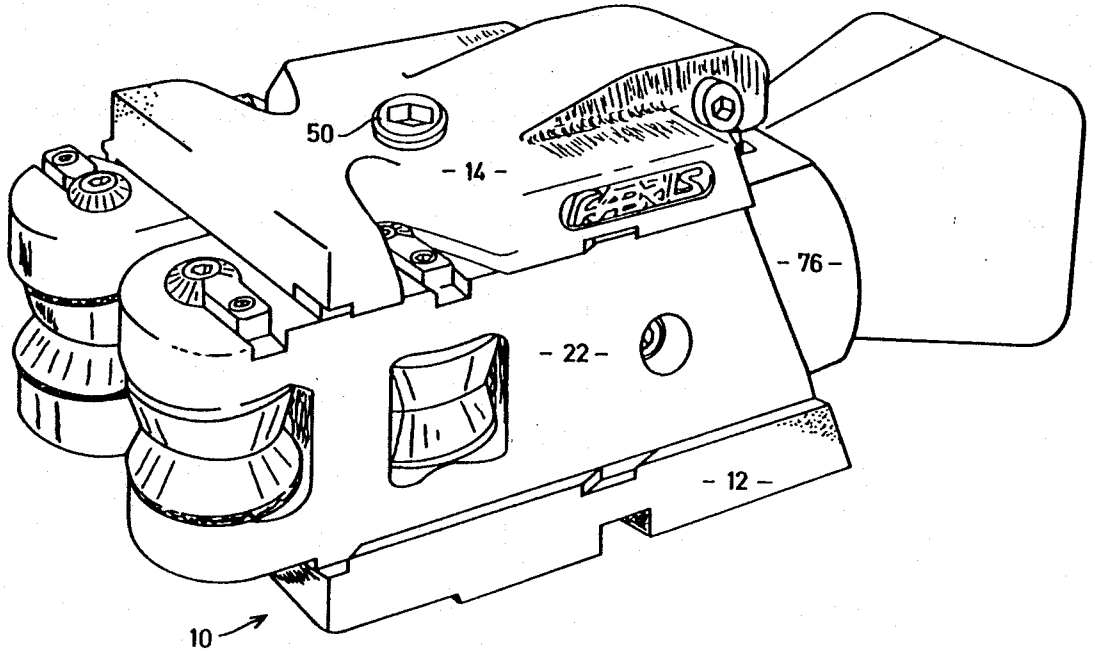
FIG. 1 is a general perspective view of a roller entry guide.
Figure 2:
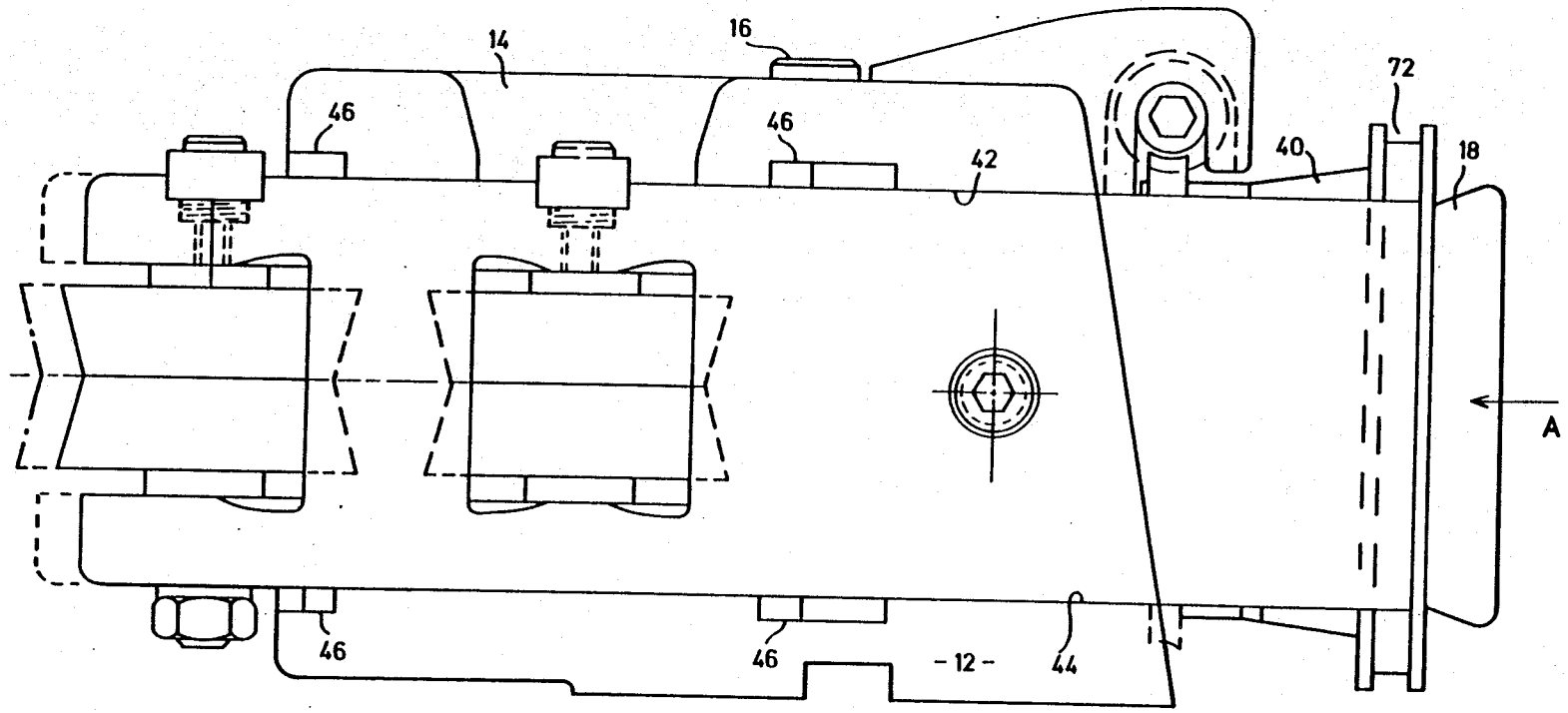
FIG. 2 is a side view of the roller entry guide shown in FIG. 1.
Figure 3:
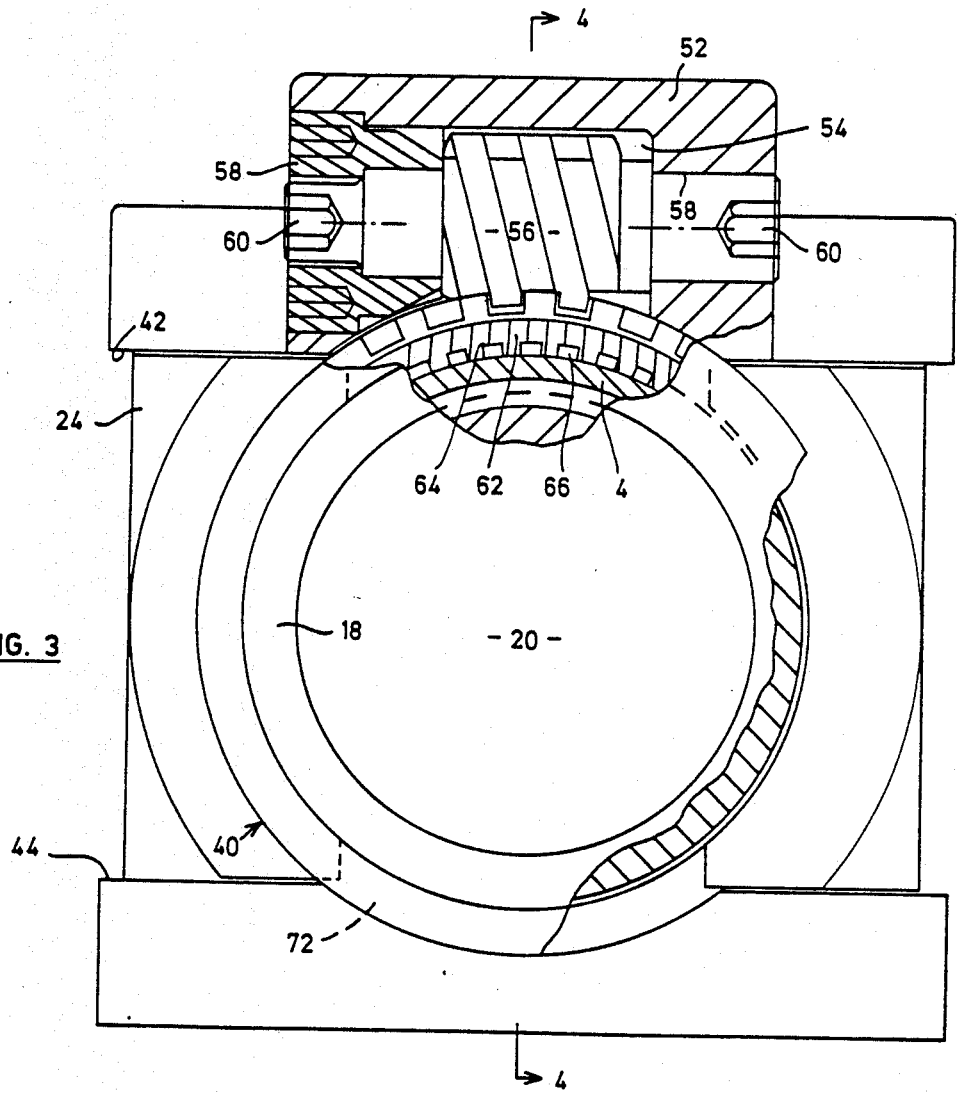
FIG. 3 is an end elevation of the roller entry guide shown in FIG. 2 taken in the direction of arrow A in FIG. 2 with portions removed for clarity.
Figure 4:
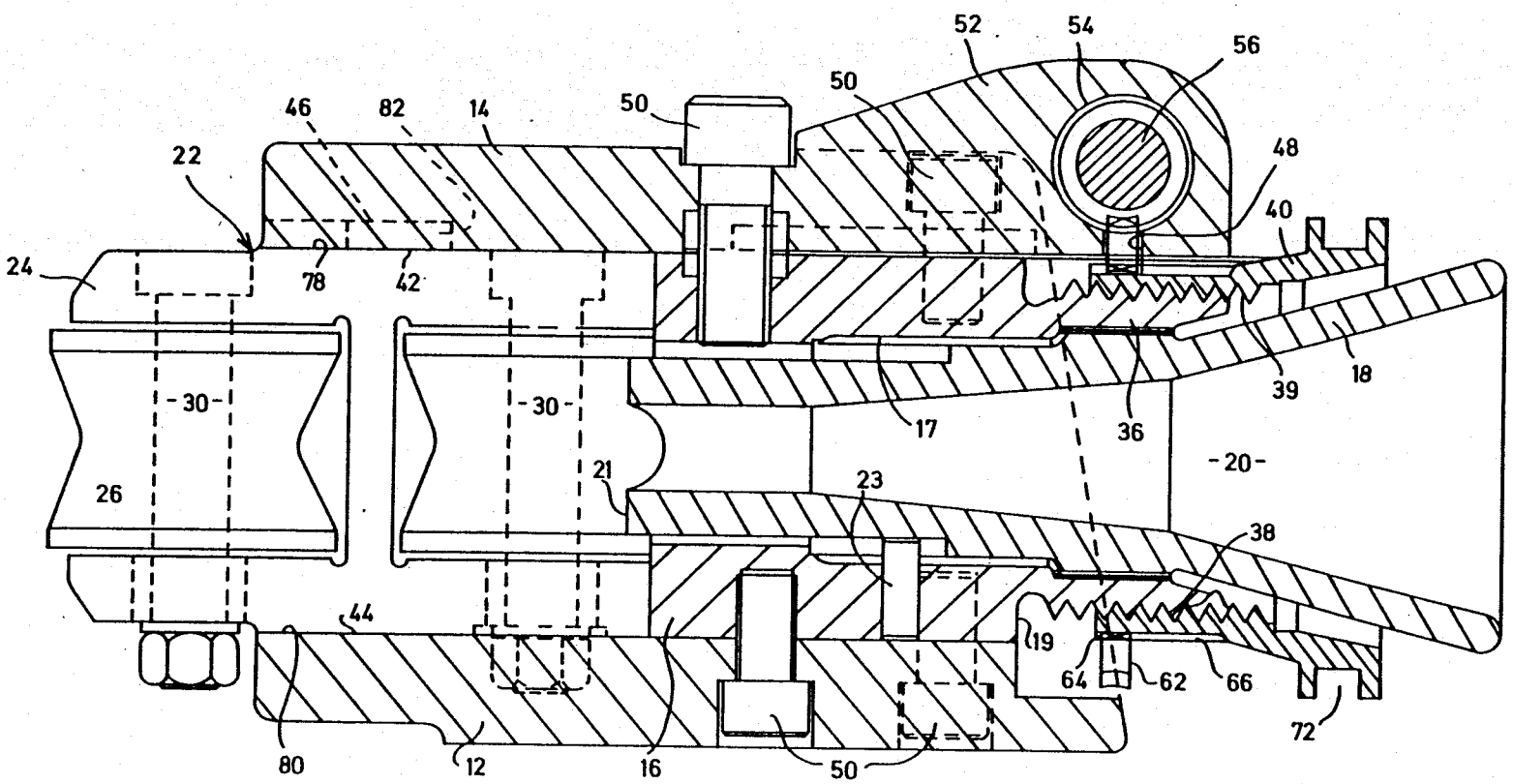
FIG. 4 is a section on the line 4—4 of FIG. 3.
Figure 5:
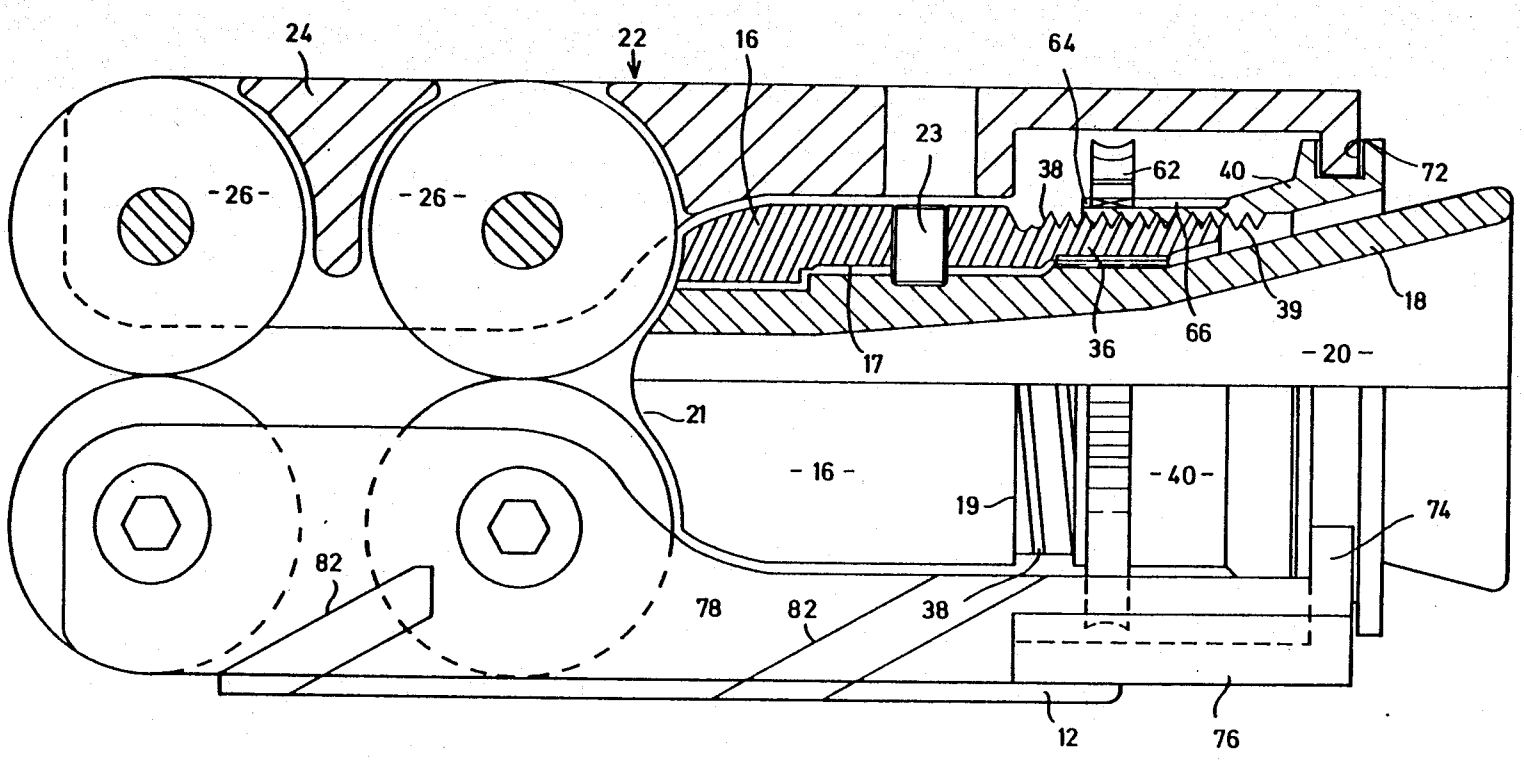
FIG. 5 is a plan view, with the top plate removed and partly in section, of the roller entry guide shown in FIG. 2.
Figure 6:
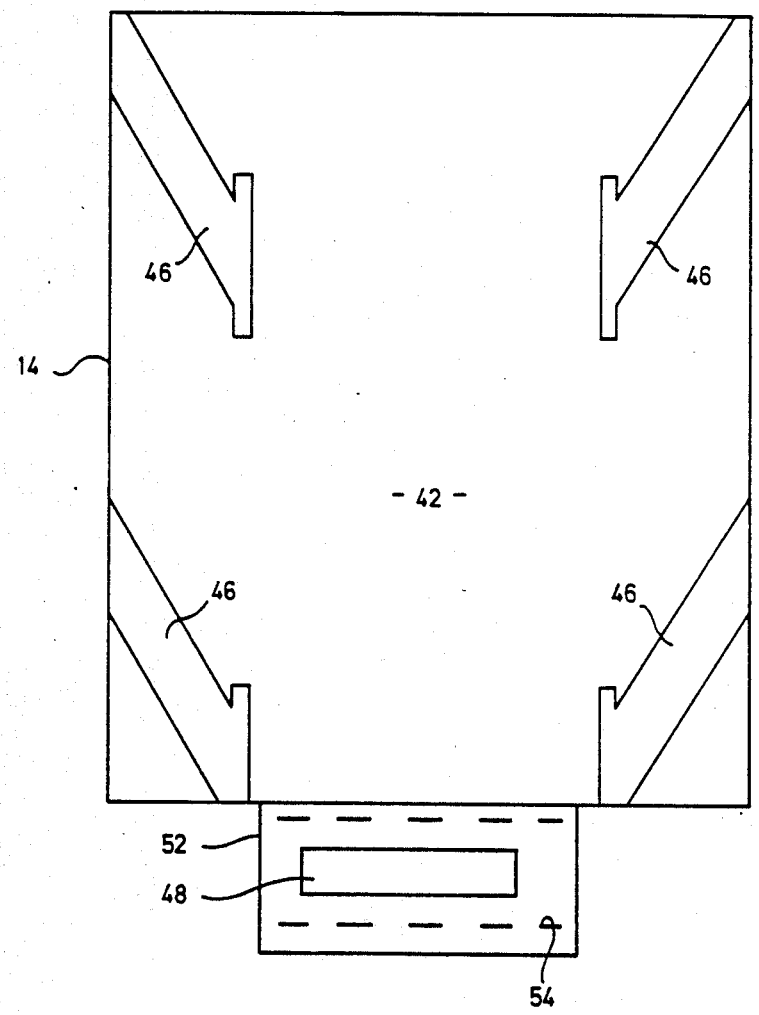
FIG. 6 is a view of the underside of the top plate used on the guide shown in FIGS. 1 to 5.

Referring now to the drawings, a roller entry guide 10 comprises a base plate 12 and a top plate 14 which are located on opposite faces of a body member generally designated 16 and secured thereto by set screws 50. The body member 16 is provided with a bore 17 that extends along the longitudinal axis of the guide 10 from a rear face 19 to a contoured nose 21. An inlet chute 18 having a throat 20 of progressively reducing cross section is threaded into the bore 17 and secured by set screws 23.

Projecting from the rear face 19 of the body 16 is an annular boss 36 that has a male thread 38 to cooperate with a female thread 39 of a collar 40. The rear portion of the collar 40 is flared to accommodate the inlet chute 18 and terminates in an outwardly directed circumferential groove 72.

The base plate 12 and top plate 14 project laterally and forwardly beyond the perimeter of body 16 to provide upper and lower opposed surfaces 42, 44 respectively. Each of the opposed surfaces 42, 44 of the plates 12, 14 is provided with guide means in the form of 4 grooves 46 arranged in pairs on opposite sides of the longitudinal axis. The grooves 46 in each pair are parallel to one another and are inclined to the longitudinal axis of the roller entry guide 10. The grooves 46 on opposite sides of the longitudinal axis are inclined at equal but opposite angles to the longitudinal axis to converge rearwardly toward the rear face 19 of body 16.

The top plate 14 is provided with an upstanding boss 52 that projects rearwardly from the top plate 14 and is provided with a transverse bore 54. Located in the bore 54 is a worm wheel 56 that is rotatably supported at opposite ends by bearings 58. The worm wheel 56 is formed with a hexagonal recess 60 at each end to receive a standard hexagonal wrench. A slot 48 is provided in the undersurface of boss 52 to intersect the bore 54 and receive a ring gear 62 that meshes with the worm wheel 56. The ring gear 62 is provided with internal splines 64 that mesh with external splines 66 provided on the outer surface of the collar 40. The splines 64–66 are orientated along the longitudinal axis of the roller entry guide 10 so that the collar 40 may move along the longitudinal axis relative to the ring gear 62. Longitudinal movement of the ring gear 62 is prevented by opposed walls 68 of the slot 48 in the under surface of the boss 52.

Located between the top plate, and base plate 14 - 12 are a pair of roller assemblies 22, each of which comprise an arm 24 carrying a pair of rollers 26 spaced along the longitudinal axis of the arm 24. Each of the rollers 26 is mounted on a vertical spindle 30 and provided with conventional bearing assemblies for rotation about a vertical axis.

Projecting rearwardly from each of the arms 24 is an extension 76 that is part circular in cross-section to accommodate the collar 40 and allow rotation of the collar about the longitudinal axis. Each extension 76 terminates in a transversely directed flange 74 that is received in the groove 72 of collar 40.

Upper and lower surfaces 78–80 respectively of the roller arms 24 are each provided with a pair of upstanding ribs 82 that are complimentary in shape to the grooves 46 and co-operate with the grooves 46 so that longitudinal displacement of the arms 24 includes a corresponding lateral displacement. Each of the rollers 26 is waisted so that opposed rollers 26 define a passage for rod passing through the chute 18 to the roll. For close control of the entry of the rod into the roll of the mill the spacing between the opposed surfaces of the rollers 26 should correspond to the nominal diameter of the rod. The guide 10 permits adjustment of this spacing during passage of the rod to accommodate minor variations in stock size.

Adjustment of the spacing between the rollers 26 is achieved by rotation of the worm wheel 56 in the bore 54. Upon rotation of the worm wheel, the ring gear 62 rotates about the longitudinal axis and causes a corresponding rotation of the collar 40. Such rotation causes intermeshing threads 38, 39 between the annular boss 36, and collar 40 to induce longitudinal displacement of the collar 40. This motion is transmitted to the the roller arms 27 through the flanges 74 to cause a corresponding longitudinal displacement of the roller assemblies. The co-operating grooves and ribs 82 cause the roller assemblies to move laterally upon longitudinal displacement and thereby alter the gap between the rollers. However, because the roller arms 26 are supported at two locations by the grooves, the two arms remain parallel to one another so that the spacing between the front and rear pairs of rollers 26 remains constant.

The disposition of the ribs and projections ensures that adequate lateral support is provided fôr the roller assemblies to resist the lateral forces produced by the rod material passing through the roller entry guide 10 whilst at the same time ensuring that the sets of rollers remain parallel at all times. The worm and wheel arrangement permits adjustment of the roller entry guides from the side of the guide without interrupting the flow of material and can be used to either increase or decrease the space between the rollers depending upon the direction of rotation of the worm wheel.

I claim:

1. A roller entry guide to guide material along a longitudinal axis, said guide having a body, a pair of generally parallel roller assemblies moveably mounted on said body, each of the roller assemblies being located on an opposite side of said longitudinal axis to define a passageway for material moving along said axis, each of said roller assemblies including an arm and a roller rotatably mounted on said arm for engagement with material passing through said passageway, adjustment means acting between said roller assemblies and said body to induce relative movement therebetween and guide means comprising co-operating slides including a passageway inclined to said longitudinal axis, said slides acting between said roller assemblies and said body to guide said roller assemblies at an angle toward and away from said longitudinal axis, and inhibit rotation of said arms relative to said body, said slides maintaining said roller assemblies in a predetermined disposition relative to said longitudinal axis upon movement induced by said adjusting means to displace said roller assemblies relative to said longitudinal axis.

2. A roller entry guide according to claim 1 wherein said guide means move said roller assemblies in a direction that is inclined to said longitudinal axis.

3. A roller entry guide according to claim 2 wherein each of said roller assemblies includes a pair of rollers rotatably mounted on said arms such that said rollers are spaced apart along said longitudinal axis, the rollers of opposed assemblies defining an elongate passageway extending along said longitudinal axis and said guide means acting to maintain the lateral spacing between said rollers uniform.

4. A roller entry guide according to claim 3 wherein a plurality of slides act between said body and each of said assemblies, said slides being spaced apart along said longitudinal axis to inhibit pivotal movement of said assembly relative to said body.

5. A roller entry guide according to claim 4 wherein each of said slides includes a groove and a complimentary rib.

6. A roller entry guide according to claim 4 wherein said adjustment means includes a collar cooperating with each of said roller assemblies and connected to said body through interengaged threads, rotation of said collar relative to said body including longitudinal displacement of said collar relative to said body and thereby induce longitudinal movement of said roller assemblies.

7. A roller entry guide according to claim 6 wherein rotation of said collar is induced by a worm and ring gear.

8. A roller entry guide according to claim 7 wherein said worm is mounted for rotation about a transverse axis and said ring gear is splined to said collar to permit relative longitudinal movement of said ring gear relative to said collar.

* * * * *